US006722803B2

(12) United States Patent
Lüttgens

(10) Patent No.: US 6,722,803 B2
(45) Date of Patent: Apr. 20, 2004

(54) SELF-CLEANING PENCIL

(75) Inventor: Fritz Lüttgens, Erlangen (DE)

(73) Assignee: KUM Limited, Co. Meath (IE)

( * ) Notice: Subject to any disclaimer, the term of this patent is extended or adjusted under 35 U.S.C. 154(b) by 0 days.

(21) Appl. No.: 10/303,316

(22) Filed: Nov. 25, 2002

(65) Prior Publication Data

US 2004/0042837 A1 Mar. 4, 2004

(30) Foreign Application Priority Data

Aug. 29, 2002 (EP) ..... 02019333

(51) Int. Cl.[7] ..... B43K 25/00
(52) U.S. Cl. ..... 401/52; 401/96; 604/309
(58) Field of Search ..... 401/52, 195, 96, 401/97; 604/289, 309; 132/318

(56) References Cited

U.S. PATENT DOCUMENTS

| | | | | |
|---|---|---|---|---|
| 5,615,962 A | | 4/1997 | Staub | |
| 5,819,993 A | | 10/1998 | Wile | |
| 5,894,669 A | * | 4/1999 | Luttgens | 30/452 |
| 6,376,046 B1 | * | 4/2002 | Hoshino et al. | 428/156 |
| 6,568,090 B2 | * | 5/2003 | Sheffler et al. | 30/457 |

FOREIGN PATENT DOCUMENTS

| | | |
|---|---|---|
| DE | 28 03 206 | 7/1978 |
| DE | 90 01 242.9 | 2/1991 |
| DE | 42 30 792 | 3/1994 |
| DE | 198 55 325 | 6/1999 |
| EP | 0 927 790 A2 | 7/1999 |
| EP | 1 072 645 | 1/2001 |

* cited by examiner

*Primary Examiner*—David J. Walczak
(74) *Attorney, Agent, or Firm*—Henry M. Feiereisen

(57) ABSTRACT

A pencil includes a writing element; and an envelope in surrounding relationship to the writing element. The envelope defines with the writing element a pencil tip and is constructed to include a cleansing material for effecting a spontaneous cleaning of the pencil tip.

30 Claims, 2 Drawing Sheets

SELF-CLEANING PENCIL

CROSS-REFERENCES TO RELATED APPLICATIONS

This application claims the priority of European Patent Application, Serial No. EP 02 019 333.0, filed Aug. 29, 2002, pursuant to 35 U.S.C. 119(a)–(d), the disclosure of which is incorporated herein by reference.

BACKGROUND OF THE INVENTION

The present invention relates, in general, to a pencil having an envelope and a writing element received in the envelope.

Normally, a pencil of this type is used to apply color on paper or other flat materials. Other uses of such pencils involve, however, situations in which the writing element, e.g. lead, comes into direct contact with the human skin. Such a pencil may in turn be used, e.g., in a kajal stick or lipstick, for application of color onto the skin, or as a care product for lips, or even for application of a cosmetic or pharmaceutical preparation. When the pencil is intended for direct contact with the skin, particular consideration should be taken as far as skin compatibility is concerned. To prevent undesired skin irritation, care should be taken in the selection of the chemical composition of the writing element of the pencil. In addition, it should be taken into account that the pencil tip remains in a clean, hygienic condition, when contacting the skin.

Contamination of the pencil tip that needs to be cleaned involves macroscopic contamination through granular, smearing or liquid material, such as, e.g., dust, skin particles or hair. When pencils are involved for use in proximity of wounds, cleaning of the pencil tip from invisible, especially microbial contamination is of particular importance. Contamination of this type relates, e.g., to an attack of the pencil tip by bacteria, viruses, mites or fungi. Since the medical or pharmaceutical field requires compliance with a very stringent hygienic standard, disposable materials, such as gloves, syringes, applicators, and the like, are normally used for administration of drugs or for carrying out therapeutic procedures, or materials are employed, such as suitable metals or plastics, which can be cleaned rapidly and thoroughly. In these areas, the use of pencils, in particular soft-core pencils, is generally not considered an option, even though their usage would be desirable in view of their easily handling.

It would therefore be desirable and advantageous to provide an improved pencil which obviates prior art shortcomings and which is constructed for use in the medical or pharmaceutical field.

SUMMARY OF THE INVENTION

According to one aspect of the present invention, a pencil includes a writing element; an envelope arranged in surrounding relationship to the writing element and defining with the writing element a pencil tip, and a cleansing material combined with the envelope for effecting a spontaneous cleaning of the pencil tip.

To ensure clarity, it is necessary to establish the definition of several important terms and expressions that will be used throughout this disclosure. The term "envelope" relates to all pencil components which are disposed permanently or temporarily in immediate adjacent relationship to the writing element, such as a barrel arranged in surrounding coaxial relationship to the writing element, or an optional cap placed over the end of the pencil for protection. The term "cleansing material" refers to any cleansing agent that is capable to eliminate macroscopic and/or microbial contamination. The terms "self-cleaning" or "automatic cleaning" or "spontaneous cleaning" are used interchangeably and are meant to refer to a cleaning action, with or without requirement for the application of external influence, to prevent the adherence of dirt or contamination as a result of the use of the cleansing material. In other words, contamination is prevented from occurring in the first place, or the contamination is eliminated as a consequence of the effect of the cleansing material, when the pencil is used, e.g. during sharpening, without necessitating a separate cleaning process of the pencil tip.

The present invention resolves prior art problems by providing the pencil with a self-cleaning action by integrating the cleaning material in the pencil. Thus, the need for a separate cleaning agent, which has to be stored separately, is eliminated. A pencil according to the present invention is thus useable for a wide variety of applications, and may be handled also by unskilled personnel without risk. Use of the novel and inventive pencil is not only possible in a clean environment as encountered in hospitals but even when exposed to unhygienic circumstances, e.g. during travel.

According to another feature of the present invention, the cleansing material is a passively cleaning substance. A passively cleaning substance involves an agent that exhibits repellency to contaminants. There are many such materials at the disposal of an artisan, which primarily repel macroscopic contamination. Examples include the use of a so-called anti-stick surface, as widely used, for example, in conjunction with kitchen utensils, and involves the provision of a smooth, tense surface structure, a chemical inertness and thus a very low friction coefficient, to thereby prevent macroscopic contaminants from adhering to the surface. A particular useful material is polytetrafluoroethylene (PTFE), which is chemically and biologically inert as well as hydrophobic and is commercially available under the name Teflon. Suitably, the envelope of the writing element may be lined with a PTFE coating, or the envelope may be made entirely of PTFE, and may be made of a composite material which contains PTFE.

According to another feature of the present invention, the envelope may have a non-wetting surface at least in an area of the pencil tip to thereby realize a repulsion of macroscopic contamination. The "non-wetting" effect of a surface is often referred to a "lotus effect" and manifests itself by the characteristic that liquids, such as water, will not adhere to the surface but rather trickle down. The lotus effect is realized by a surface which has a microscopic fine texture, e.g. in form of small naps. Thus, water as well as other contaminations contact the surface only in an area of the nap ends, i.e. only in a very small area and thus are unable to stick to the surface.

The provision of an anti-stick surface as well as a non-wetting surface prevents a deposit of macroscopic contamination. A macroscopically clean surface is, however, also suitably to inhibit a deposit of a microbial contamination, because germs can neither adhere nor grow on a clean surface. The provision of a passive cleaning action is also advantageous because no toxic or irritating agent is released so long as the pencil is used as intended. Thus, the pencil is highly compatible, especially when handled by allergic people.

According to another feature of the present invention, the cleansing material may have an actively cleaning effect, in addition or as an alternative to the passive cleaning action. An active cleaning effect relates primarily to microbial contamination and refers to a chemical agent that is toxic to or decomposes germs or fungi. An example of an active cleaning action of the writing element involves the manufacture of the envelope with a plastic that by itself has antimicrobial properties. Plastics of this type may include a polymer containing a disinfectant. Examples of suitable polymers with antimicrobial effect include those commercially available under the trademarks SAM-Polymers® or AMINA® and distributed by Creavis GmbH, Germany.

Depending of the particular application at hand, in particular on the active ingredient contained in the writing element as well as on the utilized cleansing material, there are many ways to integrate the cleansing material in the envelope. For example, in situations when the cleansing material has undesired side effects, it may be suitable to add the cleansing material as a permanent component to the envelope either in the form of a coating applied to the envelope, or spread throughout the entire envelope. In this way, contaminants are prevented from sticking in proximity of the writing element, while the cleansing material is prevented from migrating into the material of the writing element itself and thus from reaching a person's skin. An example of a suitable coating involves a coating on the basis of polyammonium salts.

When using a cleansing material that poses no health hazard and is safe to the environment, it may be suitable to formulate the cleansing material as a migrating component of the envelope material. In other words, the envelope material may contain a component which may be gaseous or liquid and escapes slowly over a long period from the envelope material As a result, the writing element is constantly exposed to discharged cleansing material, e.g., with antimicrobial effect, and thus can also be kept clean during storage.

According to another feature of the present invention, the cleansing material may be a component which is captivated in the material of the envelope and released only, when the envelope is subject to a mechanical load. This is suitable in those situations when the ejection of cleansing material is triggered by external influence, e.g., application of a mechanical force on the envelope during intended use of the pencil, e.g. during sharpening of the pencil or during a movement of the writing element relative to the envelope. In these situations, cleansing material is discharged only when the pencil is used. A targeted discharge of the cleansing material is very economical, especially during storage times, when no cleansing material is spent. Yet, a thorough cleaning of the pencil tip is realized whenever the pencil is in use. This concept can be implemented, for example, when the envelope contains a microporous carrier substance having pores for receiving the cleansing material. So long as the pores are closed, loss or aging of the cleansing material trapped in the pores is effectively countered. Only when the pores are opened, for example, upon sharpening of the pencil and accompanying cutting of the pores, is the cleansing material able to issue out and to wet the pencil tip to effect the cleaning action. Cleaning may hereby be implemented actively by killing germs, or passively, as the cleansing material forms a contamination-repellent film about the pencil tip.

There are innumerable ways of structuring a pencil according to the present invention, only several of which will be detailed here. However, other embodiments which generally follow the concepts outlined here are considered to be covered by this disclosure. Basically, the principal construction of the pencil will depend on the application at hand, i.a. also on the hardness of the used lead.

According to another feature of the present invention, the pencil may configured in the form of a lead pencil, whereby the envelope is a barrel, with the barrel and the writing element disposed in fixed surrounding coaxial relationship. The barrel may be made of wood composite or plastic. Pencils of this type can easily be sharpened as the barrel provides support and protection. During sharpening, material is removed from the old surface of the pencil tip, soiled during storage and use. The cleansing material assumes here primarily the function of preventing a renewed contamination of the exposed surface when touching a sharpening tool or contacting a person's skin.

As an alternative, the barrel and the writing element may be disposed in surrounding coaxial relationship, with the writing element being moveable relative to the barrel. This construction is suitable for pencils that include a very soft and broad writing element. Suitably, the movement of the writing element is implemented by an advancing mechanism, e.g. a rotary drive, which is generally known from lipsticks and received in the envelope to advance the writing element when applying a rotation movement. The advancing mechanism may also be configured in analogy to a retractable pencil in the form of a pressure-activated drive to advance the lead. A specific construction and manner in which a pressure-activated advancing mechanism can be operatively and functionally incorporated into the pencil of the present invention is fully described, for example, in published U.S. patent application Ser. No. 20010014248, published Aug. 16. 2001. This configuration is suitable when the pencil is provided with an exchangeable writing element. The pencil may also be configured in the form of a so-called "liquid liner", which involves the provision of a writing element in the form of a viscous or liquid fluid retained in the envelope. In this construction, the envelope includes a discharge member, e.g. a brush, ball or foam element, at the pencil tip for discharge of the writing element in controlled doses.

According to another feature of the present invention, the envelope may be lined with an impervious coating in the form of a lacquer to protect the envelope against the outside. This construction is suitable when the cleansing material migrates because the protective coating not only prevents ingress of contaminations into the envelope but also a wasteful escape of cleansing material to the outside.

According to another feature of the present invention, the cleansing material may be provided only in proximity of the pencil tip. In this way, the writing element and the contained active ingredient is exposed to the action of the cleansing material only shortly before use. Undesired long-term reactions of the active ingredient, contained in the writing element, and the cleansing material are thereby effectively precluded.

A pencil according to the present invention is suitable for use with a writing element which contains a medical or pharmaceutical active ingredient, because the integration of the cleansing material satisfies the hygienic standards without requiring additional external measures. The cleaning action of the pencil can be optimized, when the cleansing material is a combination of afore-stated formulations and, optionally, applied at different location. For example, it may be possible, to construct the envelope of several layers, with the outer layer exhibiting a passive cleaning action, while the inner layer is used for an active cleaning of the writing element. As an alternative, it may also be possible, to provide the cap and the barrel with different cleansing material. It is also conceivable to configure a pressure-activated drive for advance of the writing element in a manner that the barrel material is exposed to mechanical force at the same time as the writing element is advanced, so that the advance of the writing element is accompanied by a controlled discharge of cleansing material.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
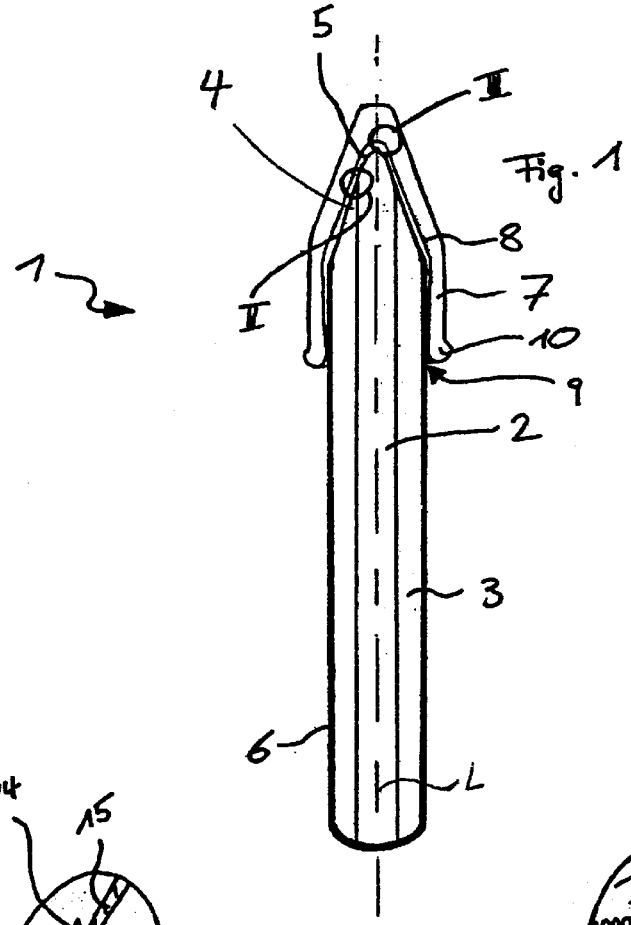
FIG. 1 is a cross section of one embodiment of a pencil according to the present invention.

Throughout all the Figures, same or corresponding elements are generally indicated by same reference numerals.

Turning now to the drawing, and in particular to FIG. 1, there is shown a cross section of one embodiment of a pencil according to the present invention, generally designated by reference numeral 1 and suitable for pharmaceutical or medical use. The pencil 1 includes a writing element 2, e.g. a lead, and an envelope 3 in the form of a barrel in substantial coaxial surrounding relationship to the writing element 2, whereby the envelope 3 and the writing element 2 are fixed to one another. The pencil 1 is defined by a longitudinal axis L and has one conically pointed end to form a pencil tip 4. Reference numeral 5 denotes the actual writing area 5 of the pencil tip 4 of the pencil 1 where the writing element 2 projects beyond the envelope 3 and is exposed. Except for the area of the pencil tip 4, the envelope 3 of the pencil 1 is lined on the outside by a protective coating 6 in the form of a lacquer.

Placed over the pencil tip 4 is a cap 7 which protects the writing element 2 during storage of the pencil 1. The cap 7 has an inside wall 8 which is configured to complement a contour of the pencil tip 4. At an end distal to the pencil tip 4, the cap 7 is open, as generally designated by reference numeral 9, and formed with a bead 10 for press-fitted seat upon the envelope 3. In this way, the cap 7 is captivated during storage and the pencil tip 4 is substantially encased in airtight manner.

Figure 2:
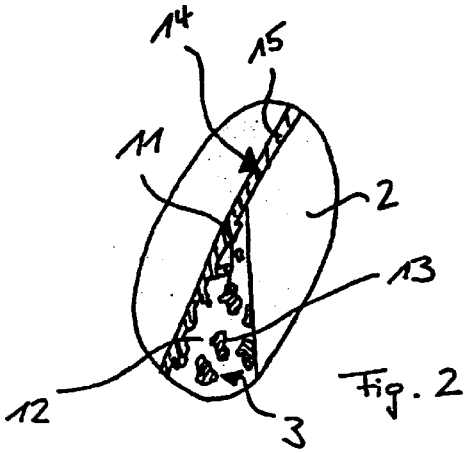
FIG. 2 is an enlarged detailed view of the area encircled in FIG. 1 and marked II.

When used for medical or pharmaceutical purposes, the writing element 2 may be made of compressed powdery or pasty material and contains a medical or pharmaceutical preparation for application, analog to the use of a normal lead pencil, by pressing the writing area 5 upon the skin of a person. To meet the stringent hygienic demands in conjunction with medical or pharmaceutical application, the envelope 3 is made of a carrier substance 12 which contains a liquid or pasty cleansing material 11, as shown schematically in FIG. 2 which is an enlarged detailed view of the area encircled in FIG. 1 and marked II. The carrier substance 12 of the envelope 3 has a microporous structure with pores 13 in which the cleansing material 11 is trapped.

The pencil 1 is sharpened each time before use with a sharpener (not shown). As a consequence of the cutting action of a cutting tool of the sharpener, the pores 13 exposed to the cutting edge of the cutting tool are cut so that the cleansing material 11, trapped in the pores 13, is able to issue out during the sharpening process to form a thin film 15 on the surface 14 of the pencil tip 4. The cleansing material 11 contains a bactericidal, anti-viral or fungicidal active ingredient to actively clean the surface 14 by killing germs or fungus spores. Depending on the intended application at hand, the volatility of the used cleansing material 11 may determine the duration of the film 15 on the surface 14. When the cleansing material 11 is readily volatile, the film 15 evaporates immediately during the sharpening process so that the surface 14 is disinfected, when the pencil 1 is used, and free of any residues of the cleansing material 11. Use of cleansing material 11 that is difficult to volatilize results in a semi-permanent film 15 which effectively seals the surface 14.

The protective coating 6 is suitably impervious for the cleansing material 11 as well as water and other contaminants. Thus, the protective coating 6 guards the envelope 3 against contamination and inhibits the cleansing material 11 from evaporating to the outside.

Figure 3:
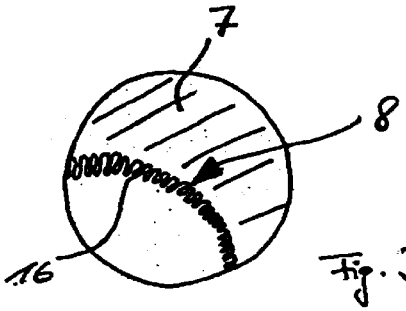
FIG. 3 is an enlarged detailed view of the area encircled in FIG. 1 and marked III.

The inside wall 8 of the cap 7 may be provided with a non-wetting surface. Such a non-wetting surface is known, e.g. from nature in the form of the lotus petal. FIG. 3 shows schematically, on an enlarged scale, the so-called "lotus effect" with microscopically small naps 16 which repel a deposit of water and contaminants.

Persons skilled in the art will understand that there are innumerable ways of formulating a suitable cleansing material for use here, only several of which will be detailed here. However, other compositions of the cleansing material which generally follow the concepts outlined here are considered to be covered by this disclosure.

Figure 4:
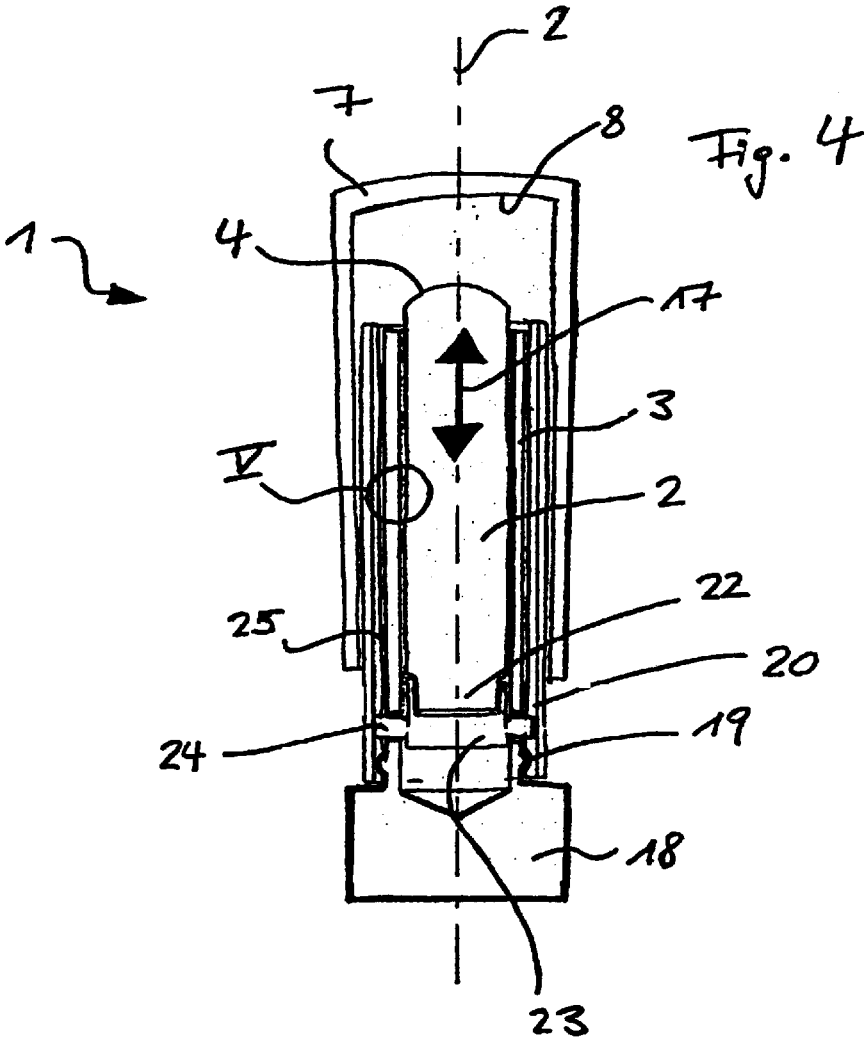
FIG. 4 is a cross section of another embodiment of a pencil according to the present invention.

Turning now to FIG. 4, there is shown a cross section of another embodiment of a pencil according to the present invention. Parts corresponding with those in FIG. 1 are denoted by identical reference numerals and not explained again. In this embodiment, provision is made for an advancing mechanism to move the writing element 2, similar to a lipstick, in longitudinal direction of the pencil 1 with respect to the envelope 3, as indicated by double arrow 17. In the non-limiting example of FIG. 4, the barrel 3 is attached in one piece to an actuator in the form of an operating head 18 which is rotatably supported in an annular groove 19 of a cylindrical outer wall 20 of the pencil 1 for rotation about the pencil axis L. The writing element 2 has one end 22, which is distal to the operating head 18, for securement to a slider 23, which, by forming part of the envelope 3, may be made, at least partially, of polytetrafluoroethylene (PTFE or Teflon) to exhibit anti-stick characteristics. The slider 23 has two protrusions 24, which jut out radially with respect to the pencil axis L and engage through respective helical slots (not shown), winding about the envelope 3 in longitudinal direction 17, in respective grooves 25 of the outer wall 20. Turning of the operating head 18 and holding the outer wall 20 at the same time results in an advance of the writing element 2 in the direction of longitudinal axis L, as indicated by double arrow 17. Such an advancing mechanism for displacement of the writing element 2 is generally known to the artisan and applied in conventional lipsticks so that a more detailed description is omitted for sake of simplicity.

Figure 5:
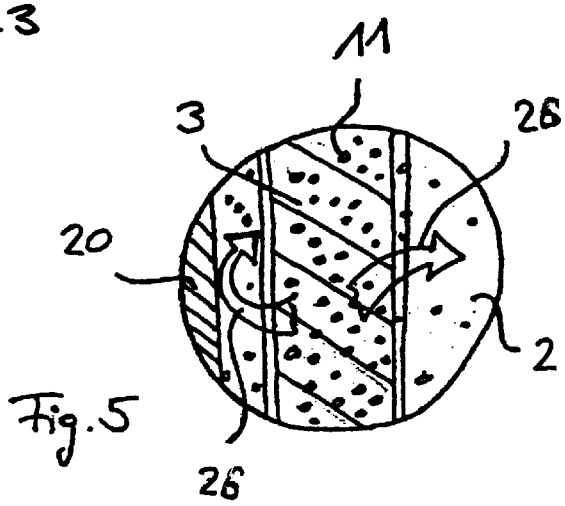
FIG. 5 is an enlarged detailed view of the area encircled in FIG. 4 and marked V.

In the nonlimiting example of FIG. 4, the envelope 3 is made of a material which contains a migrating cleansing material 11 that is able to migrate constantly and evenly from the envelope material. This effect is shown schematically in FIG. 5. When migrating out of the envelope 3, as indicated by arrows 26, the cleansing material 11 comes into contact with the writing element 2 to continuously apply a disinfecting action. The outer wall 20 is made of a material which is impervious for the cleansing material 11 and thus inhibits an escape of cleansing material 11 through the outer wall 20.

The pencil 1 illustrated in FIG. 4 can also be closed by a cap 7. The inner wall 8 of the cap 7 is hereby lined with an anti-stick coating, e.g. of polytetrafluoroethylene (PTFE, Teflon). Thus, risk of contamination of the inner wall 8 and thus of the pencil tip 4 confronting the inner wall 8, is thus effectively reduced.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and their equivalents:

What is claimed is:

1. A pencil, comprising a writing element; an envelope arranged in surrounding relationship to the writing element and defining with the writing element a pencil tip; and a cleansing material combined with the envelope for effecting a spontaneous cleaning of the pencil tip, wherein the writing element contains a medical or pharmaceutical active ingredient.

2. The pencil of claim 1, wherein the cleansing material is a passively cleaning substance.

3. The pencil of claim 2, wherein the envelope has an anti-stick surface at least in an area of the pencil tip.

4. The pencil of claim 3, wherein the envelope is made of a material which contains polytetrafluoroethylene.

5. The pencil of claim 3, wherein the envelope is made completely of polytetrafluoroethylene.

6. The pencil of claim 2, wherein the envelope has a non-wetting surface at least in an area surrounding the pencil tip.

7. The pencil of claim 1, wherein the cleansing material is an actively cleaning substance.

8. The pencil of claim 7, wherein the envelope is made of plastic which has anti-microbial characteristics.

9. The pencil of claim 8, wherein the plastic is a polymer containing a disinfectant.

10. The pencil of claim 1, wherein the envelope is made of a material, said cleansing material being a migrating component of the material of the envelope.

11. The pencil of claim 1, wherein the envelope is made of a material, said cleansing material being a component of the material of the envelope and released, when the envelope is exposed to a mechanical load.

12. The pencil of claim 11, wherein the material of the envelope has a microporous structure with pores for receiving the cleansing material.

13. The pencil of claim 12, wherein the pores of the envelope material are closed.

14. The pencil of claim 1, wherein the envelope is made of a material in which the cleansing material is contained as a permanent component.

15. The pencil of claim 1, wherein the envelope is made of a wood composite.

16. The pencil of claim 1, wherein the envelope is a barrel, said barrel and said writing element being disposed in fixed surrounding coaxial relationship.

17. The pencil of claim 1, wherein the envelope is a barrel, said barrel and said writing element being disposed in surrounding coaxial relationship, with the writing element being moveable relative to the barrel.

18. The pencil of claim 17, and further comprising an advancing mechanism supported by the envelope and constructed so that application of one of a rotation and pressure results in an advance of the writing element.

19. The pencil of claim 18, wherein the advancing mechanism includes an actuator secured to the envelope, and a slider secured to the writing element and cooperating with the actuator for translating an actuation of the actuator into an advance of the writing element, said slider being made, at, least partially, of polytetrafluoroethylene.

20. The pencil of claim 1, wherein the envelope is encased by an impervious protective coating for guarding the envelope against the outside.

21. The pencil of claim 20, wherein the protective coating includes a lacquer coat.

22. The pencil of claim 1, wherein the cleansing material is provided only in proximity of the pencil tip.

23. The pencil of claim 1, and further comprising a cap for placement over the pencil tip, said cap having a non-wetted inner surface constructed to provide repellency to contaminants.

24. The pencil of claim 1, and further comprising a cap for placement over the pencil tip, said cap having an inner surface constructed to provide anti-stick characteristics.

25. The pencil of claim 24, wherein the inner surface of the cap is coated with polytetrafluoroethylene.

26. A pencil, comprising:

a writing element;

an envelope arranged in surrounding relationship to the writing element and defining with the writing element a pencil tip, wherein the envelope is a barrel, said barrel and said writing element being disposed in surrounding coaxial relationship, with the writing element being moveable relative to the barrel;

a cleansing material combined with the envelope for effecting a spontaneous cleaning of the pencil tip; and an advancing mechanism supported by the envelope and constructed so that application of rotation results in an advance of the writing element.

27. A pencil, comprising:

a writing element;

an envelope arranged in surrounding relationship to the writing element and defining with the writing element a pencil tip, wherein the envelope is encased by an impervious protective coating for guarding the envelope against the outside; and a cleansing material combined with the envelope for effecting a spontaneous cleaning of the pencil tip.

28. A pencil, comprising:

a writing element;

an envelope arranged in surrounding relationship to the writing element and defining with the writing element a pencil tip; and a cleansing material combined with the envelope for effecting a spontaneous cleaning of the pencil tip, wherein the cleansing material is provided only in proximity of the pencil tip.

29. A pencil, comprising:

a writing element;

an envelope arranged in surrounding relationship to the writing element and defining with the writing element a pencil tip;

a cleansing material combined with the envelope for effecting a spontaneous cleaning of the pencil tip, and a cap for placement over the pencil tip, said cap having a non-wetted inner surface constructed to provide repellency to contaminants.

30. A pencil, comprising:

a writing element;

an envelope arranged in surrounding relationship to the writing element and defining with the writing element a pencil tip;

a cleansing material combined with the envelope for effecting a spontaneous cleaning of the pencil tip, and a cap for placement over the pencil tip, said cap having an inner surface constructed to provide anti-stick characteristics.

* * * * *